United States Patent [19]

Moore et al.

[11] Patent Number: 4,969,691

[45] Date of Patent: Nov. 13, 1990

[54] METHOD AND APPARATUS PERMITTING BELTWAY ADVANCE IN A MINING SCHEME

[75] Inventors: Thomas L. Moore, Shinnston, W. Va.; Robert Kaminsky, Library, Pa.; Peter F. Singleton, Pittsburgh, Pa.

[73] Assignee: Consolidation Coal Company, Pittsburgh, Pa.

[21] Appl. No.: 419,804

[22] Filed: Oct. 10, 1989

[51] Int. Cl.[5] ..... B65G 41/02; E21C 47/04

[52] U.S. Cl. ..... 299/18; 198/812; 198/861.2; 299/64

[58] Field of Search ..... 299/18, 64, 67; 198/309, 592, 812, 861.2

[56] References Cited

U.S. PATENT DOCUMENTS 3,413,035 11/1968 Lockwood ..... 299/64
3,612,257 10/1971 Goergen et al. ..... 198/161.2 X
4,852,724 8/1989 Bodimer ..... 198/861.2
4,890,720 1/1990 Brais ..... 299/67 X

FOREIGN PATENT DOCUMENTS 3621274 1/1988 Fed. Rep. of Germany ..... 198/812

*Primary Examiner*—Ramon S. Britts
*Assistant Examiner*—David J. Bagnell
*Attorney, Agent, or Firm*—Alan N. McCartney

[57] ABSTRACT

In a mining scheme, a mobile continuous haulage system follows a miner and transports material onto a floor mounted beltway. The beltway supports a roadway on which the haulage system is carried. The roadway has wheels captured in outboard rails on the beltway and lift cylinders on the roadway when lowered, raise the beltway off the floor so that the beltway can be advanced for a belt move to facilitate adding additional belt sections.

8 Claims, 3 Drawing Sheets

METHOD AND APPARATUS PERMITTING BELTWAY ADVANCE IN A MINING SCHEME

BACKGROUND OF THE INVENTION

1. Field of the Invention

This invention relates to a mining system using a mobile continuous haulage vehicle to transport mined material, the discharge end of the vehicle being carried on a roadway which interacts with a beltway in a manner facilitating the addition of belt sections of the belt conveyor supported on the beltway.

2. Summary of the Prior Art

There have been various attempts to develop mobile equipment to transport material from a continuous miner to the panel belt for removal from the mine. U.S. Pat. No. 4,476,975 discloses a conveyor system adapted to be suspended from an overhead monorail and has a feed end for receiving material from a conventional means and a discharge end over the panel belt. Commonly owned U.S. Pat. No. 4,784,257 also discloses such a material transport system. U.S. Pat. No. 3,422,949 discloses a wheel mounted mobile conveyor for transporting mined material from the miner to a belt conveyor.

Other methods of conveying the coal from the miner to the panel belt include conveyor units supporting a conveyor belt which transports the mined material. U.S. Pat. Nos. 1,932,897 and 1,999,932 illustrate this general type of mining scheme.

SUMMARY OF THE INVENTION

The purpose of this invention is to provide a mining scheme using a continuous haulage vehicle for transporting mined material from a continuous miner to a standard conveyor belt carried on a beltway. In the belt move mode, the beltway supports a roadway which raises the beltway from the mine floor to advance the beltway to facilitate the addition of standard belt structure.

It is also an object of this invention to provide an interconnection between a beltway and a roadway supporting the outboard end of a continuous haulage system, the interconnection permitting the roadway to raise the beltway off the mine floor to advance the beltway, thus reducing the man hours required to advance the standard belt structure.

It is also an object of this invention to provide a beltway which carries a roadway supporting the continuous haulage system, the roadway having wheels captured in tracks on the beltway with lift cylinders on the roadway permitting the beltway to be raised from the mine floor and advanced so that belt sections can be added during a belt move.

It is a further object of this invention to provide a beltway having a plurality of pivotally interconnected floor mounted sections to support a continuous conveyor belt, with each section having side rails; and a plurality of pivotally interconnected sections having side mounted wheels carried in the rails to form a roadway. The roadway has rails for supporting a self-propelled continuous haulage system that can tram off the rails and transport material to the beltway as a miner advances.

DESCRIPTION OF THE PREFERRED EMBODIMENT

Figure 6:
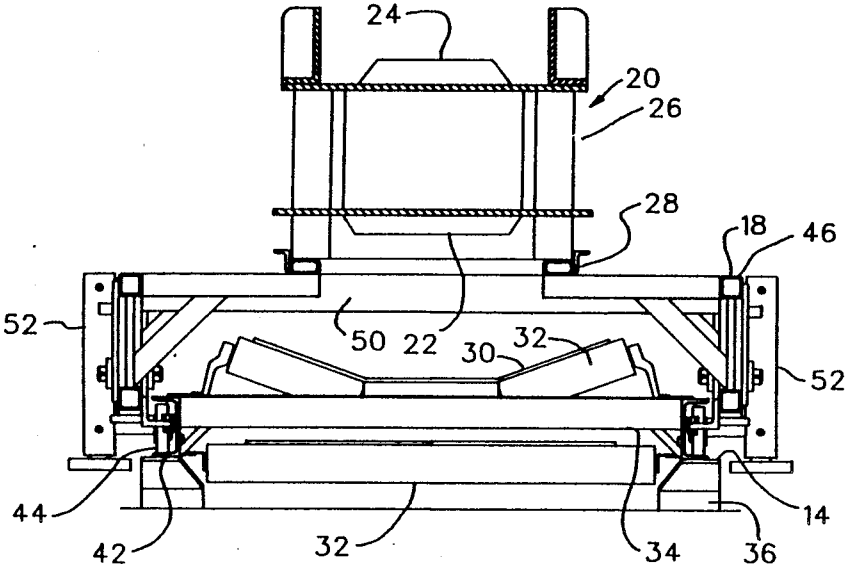
FIG. 6 is a sectional view of the haulage system, roadway and beltway.
Figure 8:
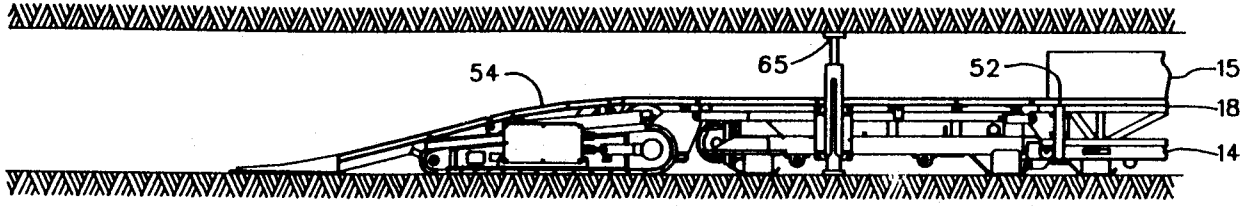
FIGS. 8 to 10 illustrate the positions of the ramp car, beltway, roadway and haulage system during a belt move.
Figure 9:
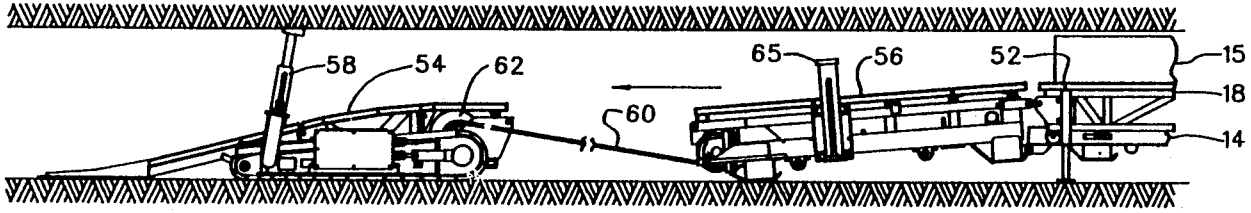
Figure 10:
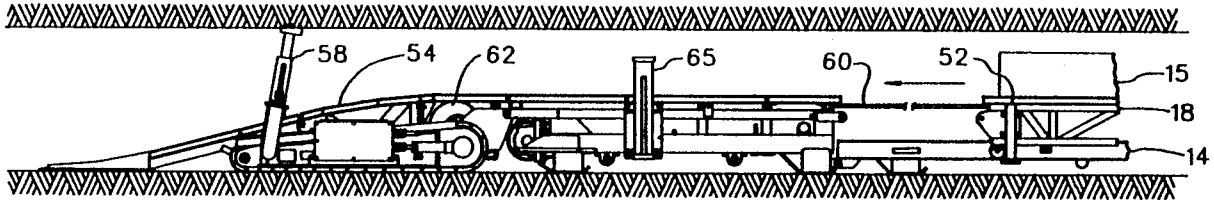

In a method and apparatus of this invention, a continuous haulage system 15 transports mined material such as coal from a continuous miner 12 to a beltway 14 which transports the mined material to a main belt 16 for transport out of the mine. The continuous haulage system 15 trams off the roadway 18 which is supported on the beltway 14 so that the self-propelled haulage system follows the miner as it advances into the face with the haulage system transporting the material to the beltway 14. The continuous haulage system can be of the type illustrated in commonly owned U.S. Pat. Nos. 4,798,279 and 4,773,520 or can be a plurality of wheel mounted articulated interconnected sections which make up a flexible conveyor train. The continuous haulage system shown herein for illustrative purposes is a tramming conveyor (see FIG. 6) which comprises a plurality of pivotally interconnected sections 20 supporting a continuous conveyor 22 having upper and lower flights 24 and outboard hydraulic cylinders 26. The cylinders 26 in the lowered position permit the conveyor flights 24 to transport mined material and with the cylinders in a raised position, the driven conveyor flights will tram the conveyor to and from the roadway on the cross members 50. Also, as mentioned, the haulage system can be a plurality of belt carrying articulated sections mounted on wheels so the system can be either self-propelled or pulled by the miner. Another haulage system which can be used is a self-propelled conveyor flight system supporting the conveyor belt as illustrated in U.S. Pat. No. 4,852,724.

The beltway 14 comprises a continuous belt 30 supported on rollers 32 supported on a frame 34 carried on skids 36. The beltway is formed from a plurality of individual units 38 interconnected at 40 to form a continuous train. The outboard frame members 42 of the beltway are channel members for supporting the wheels 44 of the roadway 18.

The roadway 18 comprises a plurality of longitudinal frame members 46 interconnected at 48 and which are supported on the wheels 44. Cross members 50 between frame members 46 support the rails 28 which carry the continuous haulage vehicle.

The frame members 46 also carry the lift cylinders 52 which in the lowered position will permit the wheels 44 to engage the channel members 42 and raise the beltway during a beltway move, as will become apparent hereinafter.

Attention is now directed to FIGS. 1 to 5 and 8 to 10 which illustrate the function of the haulage system, roadway and beltway as they interact to transport material and permit addition of belt structure as the miner advances into the face.

Figure 1:
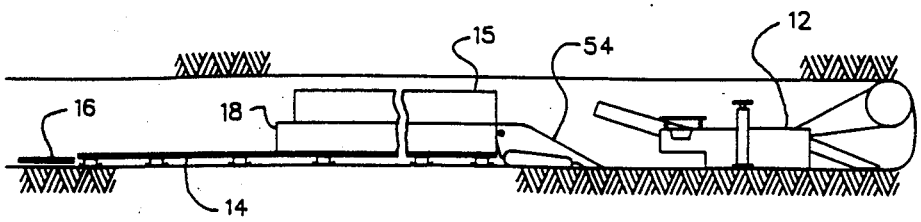
FIGS. 1 to 5 illustrate the sequence of operation of the continuous haulage system behind a continuous miner as the miner advances into the face, and the operation of the continuous haulage system, roadway and beltway during a belt move when an additional standard belt section is added.
Figure 2:
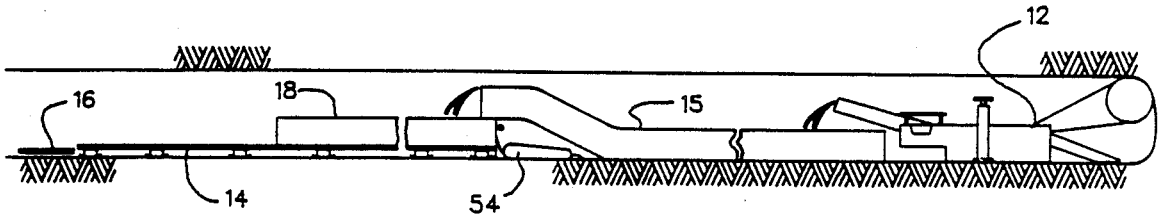

FIGS. 1 and 2 illustrate the continuous haulage system being driven or pulled off the roadway and down the ramp car 54 to follow the miner and transport the mined material to the beltway which deposits the material on the main belt. As the miner advances, the haulage system will extend to the end of the beltway (FIG. 2) at which time additional belt structure will be added with a minimum of downtime.

Figure 3:
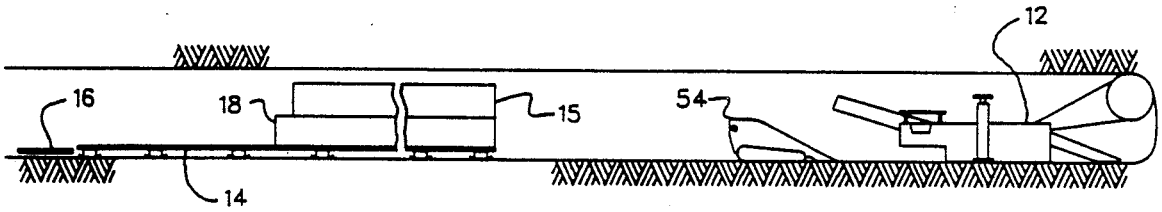
Figure 4:
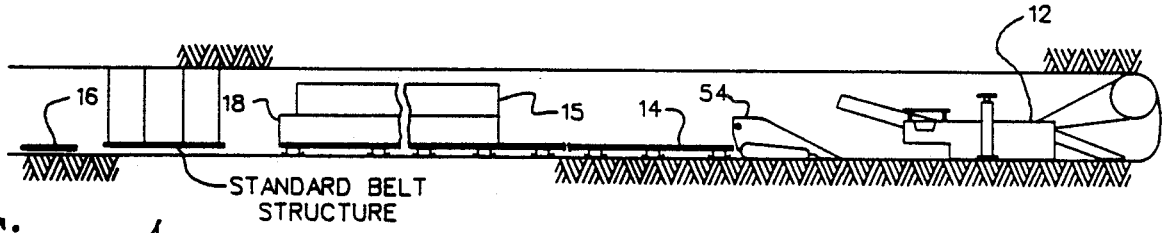
Figure 5:
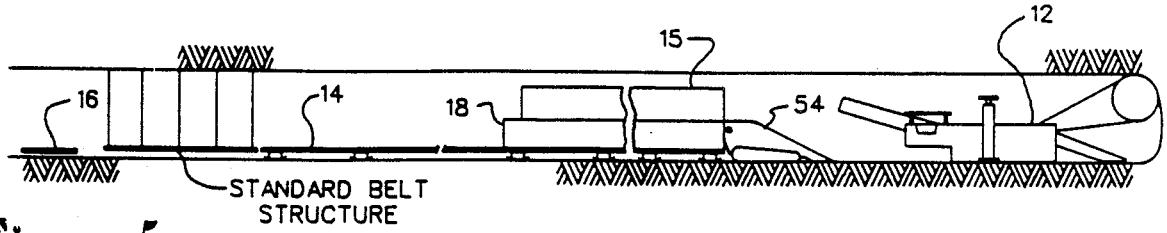

At the time of the beltway move, the continuous haulage system is driven back onto the roadway (see FIG. 3). The track driven ramp car 54 is then disconnected from the tail piece 56 of the beltway and driven up to the miner. Then, the rams 58 on the ramp car 54 are driven into the entry roof to secure the ramp car in position. The lift cylinders 52 on the roadway are then lowered to raise the beltway off the mine floor (see FIG. 9). The cable 60 from the winch 62 on the ramp car 54 is attached to tail piece 56 and the entire beltway is pulled forward with the tail piece being reattached to the ramp car (see FIGS. 4 and 10). The cylinders 52 are retracted and the cable 60 from the winch 62 is then attached to the roadway (see FIGS. 5 and 10) and the roadway with the haulage system on board is pulled forward so that the entire system is now in position for continued material transport. Additional belt structure (not shown) can then be added to the continuous belt 30. With each of the units being several hundred feet long, in this fashion, continuous mining can occur with minimum of downtime to add additional belt sections.

Figure 11:
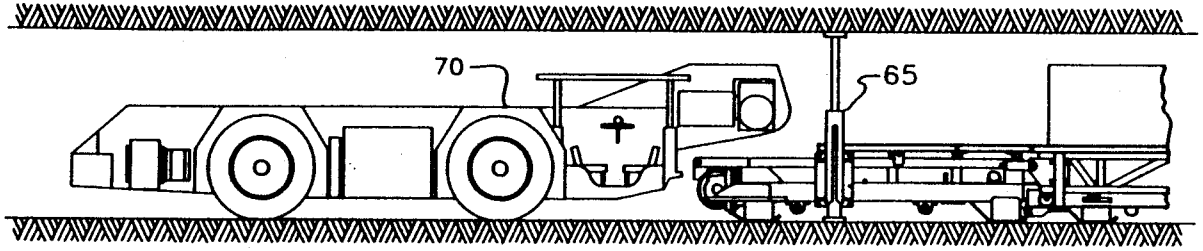
FIG. 11 is an illustration of the system used with shuttle cars.
Figure 7:
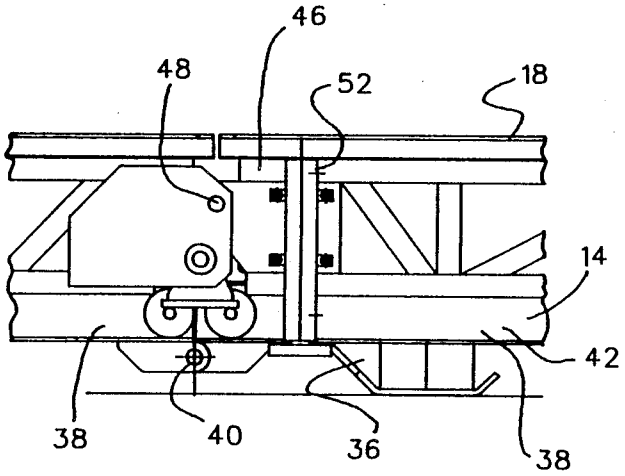
FIG. 7 is a side view of the interconnection of the roadway sections and beltway sections.

Reference is now made to FIG. 11 which illustrates the use of the roadway-beltway arrangement with shuttle cars rather than a continuous haulage system, as described above. In the event the haulage system breaks down or needs repair, the haulage system can be stored on the roadway and the ramp car 54 is detached and driven to an inactive area of the mine. A portion of the rails 28 are removed from the tailpiece 56 for better access to the belt 30, and the material can be dumped from the shuttle car 70 onto belt 30. Roof to floor jacks 65 are activated and an impact plate (not shown) is provided as on the standard tailpiece.

We claim:

1. The method of mining utilizing a roadway mounted mobile continuous haulage system following a miner for depositing mined material onto a beltway supporting the roadway comprising, a. transporting mined material on the haulage system onto the beltway, b. advancing the haulage system off the roadway onto the mine floor as the miner advances, c. returning the haulage system onto the roadway, d. raising the beltway and advancing the beltway toward that miner; and e. advancing the roadway and haulage system on the beltway toward the miner.

2. Apparatus for use in a mining scheme permitting the continuous haulage of mined material from a miner to a belt for removal of the material from the mine comprising, a. a mobile continuous haulage system adapted to transport mined material and travel behind the miner as the miner advances into the mine face;

b. a floor mounted beltway adapted to receive mined material from said system;

c. a roadway mounted on said beltway and adapted to support said system;

d. said roadway and said beltway coacting to permit said roadway to raise said beltway from the mine floor to advance said beltway toward the miner; and e. rails on said beltway capturing wheels on said roadway so that the beltway can be pulled forward from said roadway.

3. The apparatus of claim 2 including lift cylinders on said roadway permitting said roadway to raise said beltway so the beltway can be pulled forward from said roadway.

4. The apparatus of claim 2 including a self-propelled ramp car attached to the forward end of said beltway.

5. The apparatus of claim 4 wherein said ramp car can be detached from said beltway and driven forward towards said miner.

6. The apparatus of claim 5 wherein said ramp car contains means to pull said beltway forward.

7. The apparatus of claim 6 wherein said means includes a winch on said ramp car and a winch cable attachable to said beltway.

8. The apparatus of claim 5 wherein said ramp car includes rams actuated against the mine roof to stabilize said ramp car.

* * * * *